US008622281B2

(12) United States Patent
Baker

(10) Patent No.: US 8,622,281 B2
(45) Date of Patent: Jan. 7, 2014

(54) TAMPER-EVIDENT DISPENSING SPOUT

(75) Inventor: Lanny Baker, Longview, TX (US)

(73) Assignee: Closure Systems International Inc., Crawfordsville, WI (US)

( * ) Notice: Subject to any disclaimer, the term of this patent is extended or adjusted under 35 U.S.C. 154(b) by 701 days.

(21) Appl. No.: 12/757,628

(22) Filed: Apr. 9, 2010

(65) Prior Publication Data

US 2010/0258616 A1 Oct. 14, 2010

Related U.S. Application Data

(60) Provisional application No. 61/212,304, filed on Apr. 9, 2009.

(51) Int. Cl.
*B65D 43/16* (2006.01)
*B65D 43/24* (2006.01)

(52) U.S. Cl.
USPC ..... 229/123.2; 220/259.1; 220/266; 220/831; 229/125; 229/125.15

(58) Field of Classification Search
USPC ..... 229/123.2, 123.3, 125, 125.09, 125.15; 220/259.1, 266, 831, 832; 222/541.5, 222/541.6, 541.9, 556, 566
See application file for complete search history.

(56) References Cited

U.S. PATENT DOCUMENTS 1,344,039 A 6/1920 Jenson
3,417,897 A 12/1968 Johnson
3,966,080 A * 6/1976 Bittel ..... 222/541.5
4,669,640 A 6/1987 Ando et al.
4,795,065 A 1/1989 Ashizawa et al.
4,895,298 A 1/1990 Reil
5,085,331 A * 2/1992 Groya et al. ..... 220/832
5,133,486 A 7/1992 Moore et al.
5,339,993 A * 8/1994 Groya et al. ..... 222/556
5,397,013 A * 3/1995 Adams et al. ..... 222/541.6
5,509,585 A * 4/1996 Mock et al. ..... 229/125.15
6,158,197 A 12/2000 Mogard et al.
6,575,323 B1 * 6/2003 Martin et al. ..... 220/832
6,732,873 B2 * 5/2004 Bried et al. ..... 222/556

FOREIGN PATENT DOCUMENTS

JP 2007008532 1/2007

OTHER PUBLICATIONS

International Search Report and Written Opinion for corresponding PCT Application No. PCT/US10/30539.
EP Search Report issued Jul. 30, 2013.

* cited by examiner

*Primary Examiner* — Gary Elkins
(74) *Attorney, Agent, or Firm* — Wood, Phillips, Katz, Clark & Mortimer

(57) ABSTRACT

A tamper-evident dispensing spout is configured for use on single-serve cartons, such as paper-based gable-topped cartons. The spout structure includes a spout body having a generally cylindrical wall portion, and a mounting flange extending outwardly from one end of the wall portion. The spout body defines a dispensing opening generally opposite the flange portion, with an opening member hingedly mounted on the spout body for movement from a first, sealed position, to a second, opened position for consumption of the container's contents. The opening member preferably includes a locking element so that the opening member is conveniently retained in its opened position during use.

2 Claims, 2 Drawing Sheets

TAMPER-EVIDENT DISPENSING SPOUT

TECHNICAL FIELD

The present invention relates generally to a dispensing spout structure for use in conjunction with an associated gable-topped carton, and more particularly to a tamper-evident dispensing spout for use on a gable-topped carton, wherein the spout includes a hingedly movable opening member for movement from a first, closed position, wherein the dispensing spout is sealed, to a second, opened position, so that a beverage or like flowable products can be dispensed through the spout.

BACKGROUND OF THE INVENTION

Convenient consumption of beverages and the like by consumers is facilitated by providing packaging which maintains the contents of a package in a sealed condition until the contents are ready for consumption, with the package preferably configured to facilitate convenient opening and dispensing. Products of this nature can include container and closure packages, wherein a removable closure facilitates convenient consumption of the package's contents.

In order to assure the quality of a package's contents, it is desirable to provide packaging structures with a tamper-evident or tamper-indication feature to provide readily visually discernable evidence that a package has been partially or completely opened. Closure and container packages typically include tamper-indication arrangements, whereby partial or complete removal of a closure from the container provides the desired tamper-evidence.

For some applications, it can be desirable to provide paper-based containers, such as gable-topped containers for milk, fruit juice, and like beverages. For many years, gable-topped containers of this nature have been openable by configuring the gable-top of the container to generally be split and spread apart, along the top seam thereof, and the gable-top generally spread and opened to permit product dispensing.

More recently, convenient use of gable-topped containers has been facilitated by the provision of dispensing spout structures mountable on the angled, gable-top of the carton. By way of example, fruit juice gable-topped cartons typically include a dispensing spout structure, having a removable membrane, and an associated removable cap. Convenient opening, and reclosing, of the container is thus facilitated.

For some applications, single-serving dispensing of a containers contents is desired, and thus the expense of providing a recloseable structure can be avoided. At the same time, it is desirable to provide such an arrangement with a tamper-evident arrangement, thus assuring the quality of the container's contents.

The present invention is directed to a tamper-evident dispensing spout structure which desirably maintains the container in a sealed condition, which can be easily opened for consumption of the container's contents, and which desirably is unitary in nature, both prior to and subsequent to opening, thereby avoiding any waste or the like attendant to use. The spout is desirably configured to facilitate use by consumers without an associated straw or the like, and the attendant waste associated therewith.

SUMMARY OF THE INVENTION

A tamper-evident dispensing spout structure embodying the principles of the present invention is configured for mounting on an associated container, such as a gable-topped carton. The present dispensing spout can be conveniently and inexpensively configured for single-serving use, such as for use on single-serving milk cartons, or like beverage containers. Notably, the dispensing spout can be conveniently opened, from a fully sealed condition, without removal of any portion of the spout, with the spout thereafter conveniently maintained in an opened condition. Convenient use by consumers, including children, is desirably facilitated.

In accordance with the illustrated embodiment, the present dispensing spout includes a unitary spout body preferably having a generally cylindrical, annular wall portion. The spout body includes a mounting flange portion extending outwardly from one end of the wall portion, which facilitates mounting of the dispensing spout on an associated carton or like container.

The spout body defines a dispensing end, opposite the flange portion thereof, which defines a dispensing opening for the spout. The spout body further preferably includes an end wall joined to the spout wall at the dispensing end of the spout body. In the preferred embodiment, the end wall is perpendicular to the generally cylindrical wall portion of the spout body.

Dispensing of the contents of the associated container is effected by the provision of an opening member hingedly mounted on the spout body by an intregal hinge joined to the end wall. The opening member is movable from a first, closed position wherein the dispensing end of the spout is sealed, to a second, opened position wherein the dispensing end is open to permit dispensing of a flowable product through the spout body.

Notably, the opening member is retained in the closed position by a frangible membrane, joining the opening member to the wall portion at the dispensing end of the spout body. The frangible membrane desirably maintains the contents of the package in a fully sealed condition, but the membrane can be easily fractured and torn for dispensing of the container's contents. To this end, the opening member preferably includes a finger grip to facilitate manipulation of the opening member for tearing the frangible membrane, and moving the opening member from the first, closed position to the second, opened position.

Convenient use is further facilitated by the provision of a locking element on the opening member, which element is engageable with the spout body in the second, opened position of the opening member, for retaining the opening member in its opened position.

Other features and advantages of the present invention will become readily apparent from the following detailed description, the accompanying drawings, and the appended claims.

DETAILED DESCRIPTION

Figure 1:
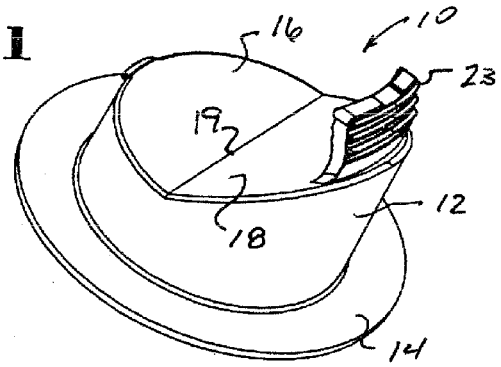
FIG. 1 is a perspective view of a tamper-evident dispensing spout embodying the principals of the present invention.
Figure 2:
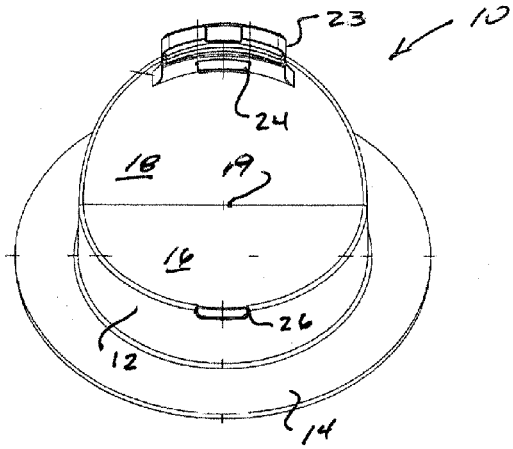
FIG. 2 is a rear perspective view of the dispensing spout of the present invention.

While the present invention is susceptible of embodiment in various forms, there is shown in the drawings, and will hereinafter be described, a presently preferred embodiment, with the understanding that the present disclosure is to be considered as an exemplification of the invention, and is not intended to limit the invention to the specific embodiment illustrated.

With reference now to the drawings, therein is illustrated a tamper-evident dispensing spout 10 embodying the principles of the present invention. Notably, a dispensing spout is of a unitary, one-piece construction, thereby facilitating convenient and cost-efficient use on an associated container, such as a gable-topped paper carton. By virtue of its straightforward design, the present dispensing spout can be economically used in connection with suitable cartons or like containers, and at the same time is configured for efficient molding, such as by injection molding, from suitable polymeric material, such as polyethylene, polypropylene, suitable copolymers, and the like.

In accordance with the illustrated embodiment, the dispensing spout 10 includes a unitary spout body having an annular wall portion 12, which is preferably cylindrical, and a mounting flange portion extending outwardly from one end of the wall portion 12. Mounting flange 14 is configured for sealed fitment to an associated carton, such as at the gable of a gable-topped paper carton.

In accordance with the illustrated embodiment, the spout body preferably includes an end wall 16, opposite the mounting flange 14, which partially closes one end of the annular wall portion 12. In the preferred form, the end wall 16 is positioned perpendicular to the cylindrical wall portion 12.

Figure 5:
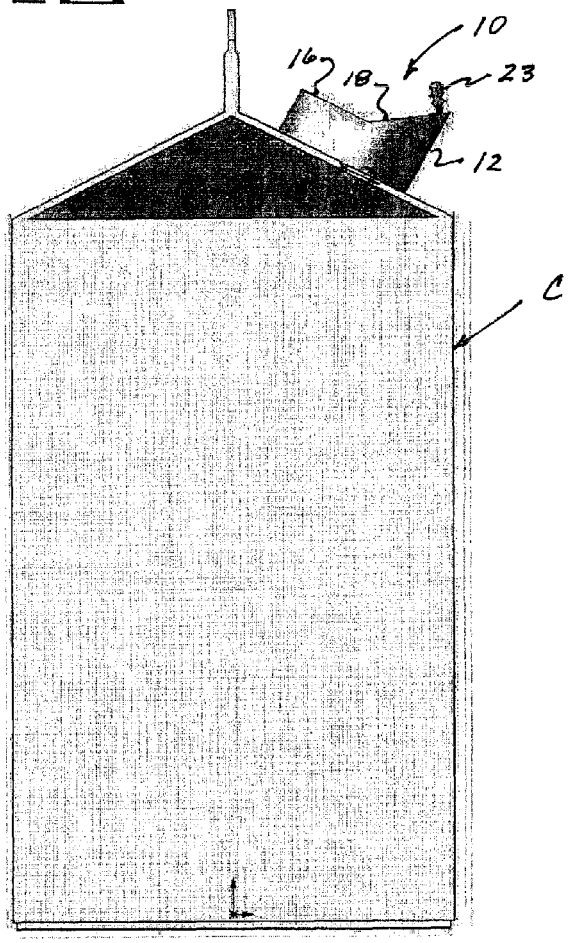
FIG. 5 is a side-elevational view of a container in the form of a gable-topped carton having the dispensing spout of the present invention mounted thereon.

The spout body of the dispensing spout defines a dispensing end generally opposite flange portion 14, at which end wall 16 is provided. The dispensing end defines a dispensing opening for the spout, with the spout body having a moveable opening member 18 hingedly mounted thereon by an integral hinge 19, hingedly joining the opening member 18 to the end wall 16. In accordance with the preferred, illustrated embodiment, the opening member 18 is joined to the end wall 16 along a hinge axis which generally bisects a cylinder defined by the cylindrical wall portion 12 of the spout body. The dispensing opening is preferably disposed at an obtuse angle with respect to the end wall 16, so that, as shown in FIG. 5, the spout body provides a mouthpiece for consumers when the spout is mounted on an associated container C.

In order to permit dispensing of the contents of an associated container, the opening member 18 is movable from a first, closed position, as illustrated in the drawings, to a second, opened position, wherein the dispensing opening of the dispensing end of the spout body is opened. Movement in this fashion is effected by hingedly moving opening member 18 about the integral hinge 19, so that the opening member is generally moved from within the dispensing opening of the spout. In the illustrated embodiment, the opening member is movable through an arc of 145°, corresponding to the obtuse angle at which the dispensing opening of the spout is oriented relative to the end wall. The specific angular orientation of the opening can be varied as desired, such as for use of the present spout on a container that does not have an angular gable top.

Figure 3:
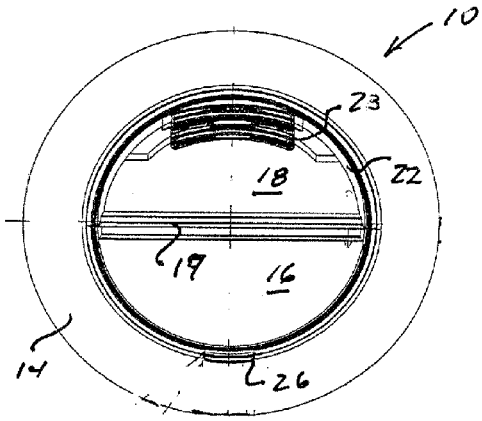
FIG. 3 is a top plan view of the present dispensing spout.

Prior to opening in this fashion, the dispensing spout is maintained in a closed, fully sealed condition by the provision of a frangible membrane 22 (FIG. 3) which has a generally semi-circular configuration, extending about the opening member 18 from one end of hinge 19 to the other. In a current embodiment, the membrane 22 has been formed to have a thickness on the order of 0.004-0.005 inches to promote convenient fracture and tearing by consumers for opening the dispensing spout.

The opening member 18 is preferably provided with an integral finger grip 23 to facilitate manipulation of the opening member for tearing the frangible membrane 22, and for moving the opening member from its first, closed position to its second, open position.

Figure 4:
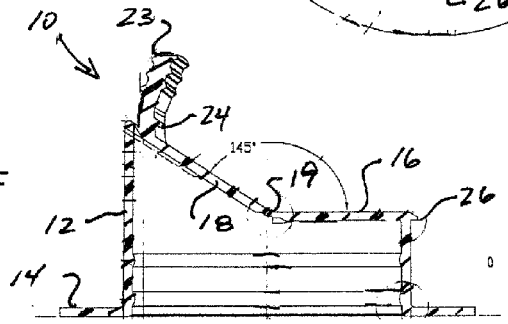
FIG. 4 is a cross-sectional view of the dispensing spout of the present invention.

As will be noted from FIG. 4, the finger grip 23 extends generally parallel to the wail portion 12 of the spout body to facilitate molding of the present dispensing spout without resort to cam-action or slide-action mold components.

Convenient use of the present dispensing spout is further facilitated by the provision of a locking element 24 provided on the opening member 18 generally at the base of finger grip 23. The locking element 24 is engageable with a retention tab 26 on the spout body when the opening member has been moved to its fully opened, second position. The locking element 24 engages the retention tab with a snap-like action to maintain the opening member in its opened position. The dispensing spout 10 is preferably mounted on an associated container so that the now-opened dispensing opening is oriented generally at the lower extent of the dispensing spout, with the now-opened opening member 18 positioned thereabove, thus permitting convenient dispensing of the contents of the associated container. If desired, the present dispensing spout can be conveniently dimensioned, such as having a diameter of the wall portion on the order of 0.7 inches, so that a user can conveniently place their mouth on the dispensing spout for consumption of the associated beverage or the like. Because the use of the present dispensing spout is contemplated for single-serve containers, the need to configure the spout for reclosing and sealing can be economically avoided. At the same time, the spout structure can be conveniently opened, yet all components of the structure remain integrated, including the opening member 18 retained by integral hinge 19, thus desirably avoiding any waste or the like associated with the use of the present dispensing spout.

From the foregoing, it will be observed that numerous modifications and variations can be effected without departing from the true spirit and scope of the novel concept of the present invention. It is to be understood that no limitation with respect to the specific embodiment illustrated herein is intended or should be inferred. The disclosure is intended to cover, by the appended claims, all such modifications as fall within the scope of the claims.

What is claimed is:

1. A tamper-evident dispensing spout and carton, comprising:

a gable-topped carton having a pair of downwardly diverging end walls which extend downwardly from a peak portion, a unitary spout body having a generally cylindrical, annular wall portion, and a mounting flange portion extending outwardly from one end of said wall portion, and joined to one of said downwardly diverging end walls, said spout body defining a dispensing end, opposite said flange portion, which defines a dispensing opening for said spout, said spout body further including an end wall joined to said spout wall at said dispensing end of said spout body, said spout body having an opening member hingedly mounted thereon by an integral hinge joined to said end wall, said opening member being movable from a first, closed position wherein said dispensing end is sealed, to a second, open position, wherein said dispensing end is open to permit dispensing of a flowable product through the spout body, said opening member being retained in said closed position by a frangible membrane, joining said opening member to said wall portion at said dispensing end of said spout body, said opening member includes a finger grip to facilitate manipulation of said opening member for tearing said frangible membrane and moving said opening member from said first, closed position to said second, opened position, said opening member including a locking element, engageable with said annular wall portion of said spout body in the second, opened position of said opening member for retaining said opening member in said opened position, said end wall being generally perpendicular to said wall portion, and said integral hinge generally bisecting a cylinder defined by said cylindrical wall portion, with said dispensing opening opens generally upwardly and is disposed at an obtuse angle with respect to said end wall.

2. A tamper-evident dispensing spout in accordance with claim 1, wherein:

said finger grip extends generally parallel to said wall portion to facilitate molding of said dispensing spout.

* * * * *